US005462107A

United States Patent [19]

Hasegawa et al.

[11] Patent Number: 5,462,107

[45] Date of Patent: Oct. 31, 1995

[54] VACUUM CASTING METHOD

[75] Inventors: Tamotsu Hasegawa; Yasuyuki Arakawa, both of Nagoya; Atushi Ota, Toyota, all of Japan

[73] Assignee: Toyota Jidosha Kabushiki Kaisha, Toyota, Japan

[21] Appl. No.: 266,549

[22] Filed: Jun. 28, 1994

[30] Foreign Application Priority Data

Jun. 30, 1993 [JP] Japan ..... 5-160789

[51] Int. Cl.[6] ..... B22D 18/04; B22D 18/06

[52] U.S. Cl. ..... 164/63; 164/119; 164/120

[58] Field of Search ..... 164/63, 119, 120, 164/254, 306, 309

[56] References Cited

FOREIGN PATENT DOCUMENTS

| | | | |
|---|---|---|---|
| 0559920 | 9/1993 | European Pat. Off. . | |
| 61-182868 | 8/1986 | Japan . | |
| 2-155557 | 6/1990 | Japan . | |
| 2-229660 | 9/1990 | Japan | 164/120 |
| 3-31058 | 3/1991 | Japan . | |
| 3-68955 | 7/1991 | Japan . | |
| 3-198969 | 8/1991 | Japan . | |
| 4-158968 | 6/1992 | Japan . | |
| 4-274860 | 9/1992 | Japan . | |
| 5-123845 | 5/1993 | Japan . | |
| 5-146863 | 6/1993 | Japan . | |
| 5-146864 | 6/1993 | Japan . | |
| 5-146865 | 6/1993 | Japan . | |
| 5-169232 | 7/1993 | Japan . | |
| 5-192759 | 8/1993 | Japan . | |
| 5-63264 | 9/1993 | Japan . | |

OTHER PUBLICATIONS

Patent Abstract of Japan No. JP 5-192759 Published Aug. 3, 1993.

*Primary Examiner*—J. Reed Batten, Jr.
*Attorney, Agent, or Firm*—Cushman, Darby & Cushman

[57] ABSTRACT

In a vacuum casting method, a molding cavity is reduced in pressure to a vacuum, and when a gate is opened, a molten metal which has been raised to a molten metal retaining dome is charged into the molding cavity at a high speed. When a portion of a molten metal held in a molten metal holding furnace is raised to the molten metal retaining dome via a stalk, (1) the rising speed of a portion of the molten metal is set at 5–10 cm/sec, or (2) the rising speed is varied between an early stage of the rising motion and a later stage of the rising motion. In the latter method, the rising speed at the early stage of the rising motion is set at a speed higher than 10 cm/sec, while the rising speed at the later stage of the rising motion is set at 5–10 cm/sec. Due to the rising speed control, air involvement by the rising molten metal is effectively prevented.

7 Claims, 2 Drawing Sheets

VACUUM CASTING METHOD

BACKGROUND OF THE INVENTION

1. Field of the Invention

The present invention relates to a vacuum casting method of the type wherein a molding cavity is reduced in pressure to a vacuum and upon opening a gate, a molten metal is charged into the molding cavity at a high speed. More particularly, the present invention relates to an improved vacuum casting method in which bubbles and solid metal pieces are prevented from being involved in the molten metal as it is charged into the molding cavity.

2. Description of Related Art

As one example of a light alloy casting method of a high quality and a low cost, a vacuum precharged closed squeezed casting method was proposed by the present applicant in Japanese Patent Application No. HEI 4-309534 filed on Oct. 23, 1992.

In the proposed vacuum casting method, a molding cavity is shut off from an interior of a molten metal retaining dome by a gate. Then, the molding cavity is reduced in pressure to a vacuum, and substantially simultaneously a portion of a molten metal held in a molten metal holding furnace is raised to the molten metal retaining dome. Thereafter, the gate is opened so that the molten metal in the molten metal retaining dome is charged into the molding cavity at a high speed due to the vacuum in the molding cavity. The molding cavity is then shut-off by a shut pin, and the molten metal in the molding cavity is pressurized by inserting a pressure pin into the molding cavity. Thereafter, the molten metal in the molding cavity is cooled to be solidified.

In the proposed vacuum casting method, since the molding cavity is reduced in pressure to a vacuum before the molten metal is charged into it, the molten metal has few or no bubbles once in the molding cavity. But, because of the vacuum generated in the molding cavity, the charging speed of the molten metal is very high. The vacuum casting method allows the molten metal to run smoothly in the molding cavity and, as a result, slimmer and lighter casting products are possible.

However, to realize a higher quality of casting using the above-described vacuum casting method, it is necessary to prevent the molten metal from involving air when it rises in the molten metal retaining dome via a stalk from a molten metal holding furnace, because the molten metal contacts air in the stalk and in the molten metal retaining dome.

SUMMARY OF THE INVENTION

An object of the present invention is to provide a vacuum casting method which prevents air involvement by a molten metal when rising in a stalk and in a molten metal retaining dome, while not lowering production efficiency.

The above-described object is achieved by a vacuum casting method in accordance with the present invention which includes isolating a molding cavity from a molten metal retaining dome. A pressure in the molding cavity is then reduced. Thereafter, molten metal is moved through the molten metal retaining dome with a final rising speed of between about 5 and 10 cm/sec. The molten metal is then charged into the molding cavity by opening a passage. The molten metal in the molding cavity is then pressurized and allowed to solidify.

In a first embodiment of the present invention, the rising speed of the molten metal is controlled to be about 5–10 cm/sec at all stages of the rising motion of the molten metal.

In a second embodiment, the rising speed of the molten metal is changed between an early stage and a later stage of the rising motion. More particularly, a first rising speed of the molten metal at an early stage of the rising motion of the molten metal is controlled to be a speed higher than about 10 cm/sec, and a second rising speed of the molten metal at a later stage of the rising motion of the molten metal is controlled to be about 5–10 cm/sec.

It was found by testing that the rising speed of a molten metal in the stalk and in the retaining dome were factors which affected air involvement by the molten metal. The inside surface of the stalk, which is constructed of ceramics, has a rough surface and a low wettability with the molten metal. Therefore, it was found that when the molten metal is raised at a high speed, ripples occur at the surface of the molten metal and air involvement by the molten metal is seen in the molten metal. However, when the molten metal is raised at a speed lower than 10 cm/sec, air involvement by the molten metal is negligible. It was then determined through testing that an upper limit of the rising speed of the molten metal at the later stage of the rising motion should be controlled to be about 10 cm/sec. It was also determined that too low a speed would prolong the molding cycle time and therefore decrease the production efficiency. Thus, a lower limit of the rising speed of the molten metal was determined to be about 5 cm/sec.

Furthermore, if the rising speed of the molten metal is too high, the molten metal involves air at an early stage of the rising motion, and the involved air forms bubbles which rise to the upper surface of the molten metal due to buoyancy before the surface of the molten metal reaches a level higher than that of the gate in the molten metal retaining dome. Thus, in the method of the second embodiment, the rising speed of the molten metal is increased at the early stage of the rising motion of the molten metal, so that production efficiency was improved. However, if the molten metal involves air at the final stage of the rising motion, the bubbles will flow into the molding cavity upon opening the gate before the bubbles can rise to the surface of the molten metal due to buoyancy. Thus, the rising speed of the molten metal at the later stage of the rising process of the molten metal was controlled to the speed selected according to the first embodiment in which no air involvement by the molten metal occurred.

BRIEF DESCRIPTION OF THE DRAWINGS

The above and other objects, features, and advantages of the present invention will become more apparent and will be more readily appreciated from the following detailed description of the preferred embodiments of the invention taken in conjunction with the accompanying drawings, in which.

Figure 6:
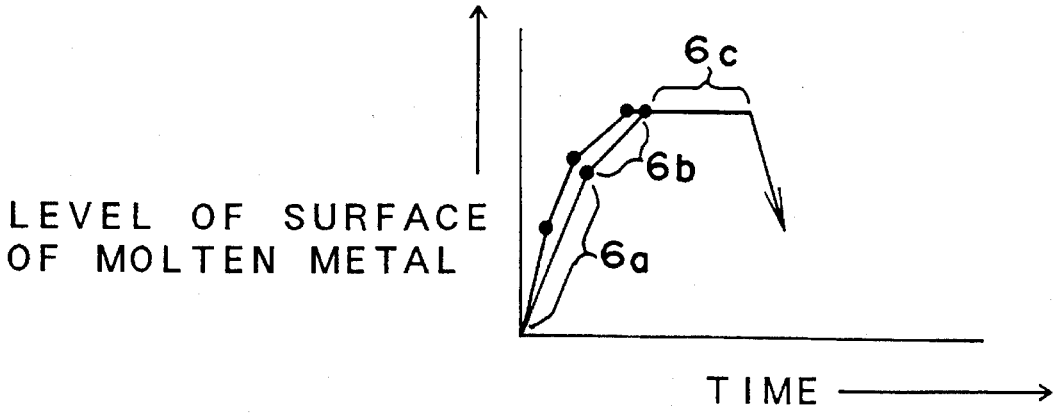
Figure 7A:
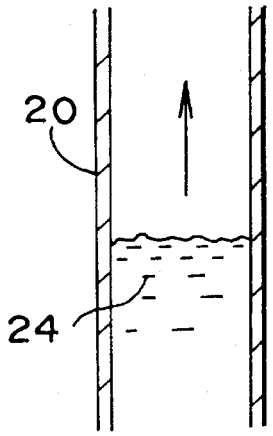
Figure 7B:
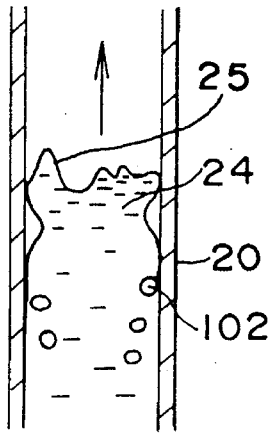

FIG, 5 is a graphical representation of a level of a molten metal versus time characteristic in a method in accordance with a first embodiment of the present invention;

FIG. 6 is a graphical representation of a level of a molten metal versus time characteristic in a method in accordance with a second embodiment of the present invention; and FIGS. 7A and 7B are cross-sectional views of a stalk and a molten metal, illustrating air involvement by the molten metal in a case where a rising speed of the molten metal is lower and higher than about 10 cm/sec, respectively,

DETAILED DESCRIPTION OF THE PREFERRED EMBODIMENTS

FIGS. 1–4 illustrate structures common to all of the embodiments of the present invention. FIG. 5 illustrates structures specific to a first embodiment of the present invention, and FIG. 6 illustrates structures specific to a second embodiment of the present invention. FIGS. 7A and 7B illustrate air involvement by a molten metal when a rising speed of the molten metal is lower and higher than a predetermined upper limit for no-involvement of air. Throughout all the embodiments of the present invention, portions having the same or similar structures are denoted with the same reference numerals.

First, structures and operation common to all the embodiments of the present invention will be explained with reference to FIGS. 1–4.

The apparatus of the present invention is much simpler than those of conventional apparatuses. More particularly, the casting apparatus for conducting a vacuum casting method of the present invention does not have a molten metal injection mechanism like the conventional high pressure casting apparatus or the conventional die casting apparatus. Compared with the conventional low pressure casting apparatus, the vacuum casting apparatus of the present invention is provided with a gate for shutting off the molding cavity from the molten metal retaining dome and a pressure reducing mechanism for reducing the pressure in the molding cavity, so that the molding cavity can be charged with a molten metal at a high speed using a pressure difference between the vacuum generated in the molding cavity and the atmospheric pressure retained in the molten metal retaining dome.

More particularly, a molding die assembly which includes an upper die 2 and a lower die 4 is capable of being opened and closed by moving the upper die 2 relative to the lower die 4 in a vertical direction. The upper die 2 and the lower die 4 define at least one molding cavity 6 therebetween. In the embodiment of FIGS. 1–4, a plurality of molding cavities 6 are arranged around a molten metal retaining dome 8, which is located at a central portion of the molding die assembly, and extends radially. The molten metal retaining dome 8 is movable in a radial direction relative to the upper die 2. The molding cavity 6 can be shut-off or isolated from the interior of the molten metal retaining dome 8 by a gate 10 which is formed at a lower end of the molten metal retaining dome 8. The gate 10 is closed when the molten metal retaining dome 8 is in a lowered position, and is opened when the molten metal retaining dome 8 is in a raised position. The molding cavity 6 is connected to a pressure reducing pump (not shown) via a suction port 26 and can be reduced in pressure to a vacuum after the molding die assembly is closed and the molding cavity 6 is shut-off by the gate 10.

The molten metal retaining dome 8 communicates with a molten metal holding furnace 22 via a sprue 12 formed in the lower die 4 and a stalk 20 connecting the sprue 12 to the molten metal holding furnace 22. The molten metal holding furnace 22 is housed in a closed chamber, and a pressure of an interior of the closed chamber can be controlled by a pressure pump (not shown) connected to the closed chamber via a pressure port 28. When the pressure of the interior of the closed chamber is increased and the increased pressure acts on a free surface of the molten metal held in the molten metal holding furnace 22, a portion of the molten metal 24 held in the molten metal holding furnace 22 is raised into the molten metal retaining dome 8. An inside surface of the stalk 20 is made of ceramics.

A shut pin 16 movable relative to the upper die 2 is provided to shut-off a runner 14 connecting the interior of the molten metal retaining dome 8 to the molding cavity 6. The molding cavity 6 is shut-off or isolated from the interior of the molten metal retaining dome 8 by the shut pin 16 after the molten metal has been charged into the molding cavity 6. A pressure pin 18 movable relative to the upper die 2 is provided in the molding cavity 6, and the molten metal charged into the molding cavity 6 can be pressurized by inserting the pressure pin 18 into the molding cavity 6 before the molten metal in the molding cavity 6 is solidified.

Figure 1:
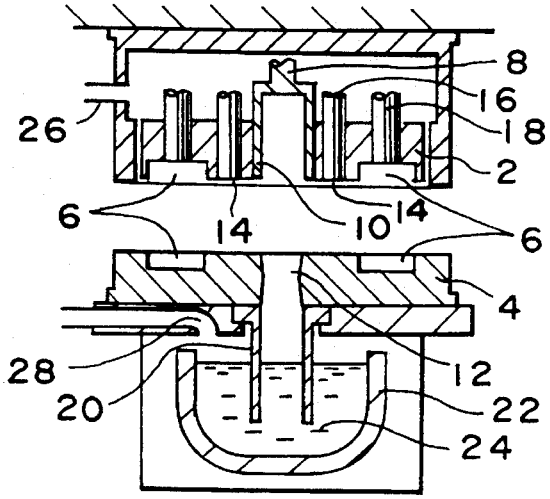
FIG. 1 is a cross-sectional view of a casting apparatus, in a state wherein the dies are opened, for conducting a vacuum casting method in accordance with any embodiment of the present invention.
Figure 2:
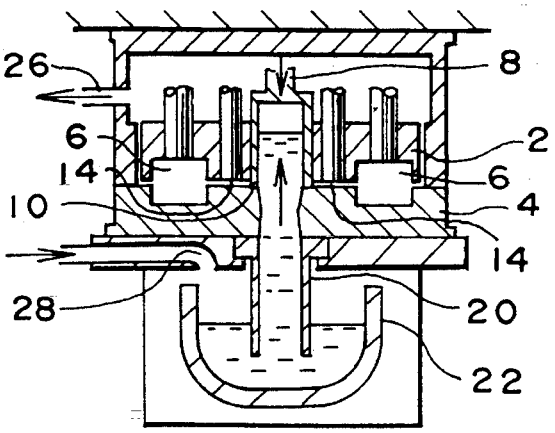
FIG. 2 is a cross-sectional view of the apparatus of FIG. 1 in a state where the dies are closed and a molding cavity has been reduced in pressure.

Using the above-described apparatus, a vacuum casting method of the invention is conducted as follows:

First, the molding die assembly is closed, by which the state of the casting apparatus shown in FIG. 1 is changed to the state shown in FIG. 2. Then, the molten metal retaining dome 8 is lowered relative to the upper die 2, so that the gate 10 closed and thereby isolates the molding cavity 6 from the interior of the molten metal retaining dome 8 which communicates with the atmosphere. Then, the molding cavity 6 is reduced in pressure to a vacuum by operating the pressure reducing pump connected to molding cavity 6 via the suction port 26. The method of the present invention allows the vacuum generated in the molding cavity 6 to be higher than about 50 torr, and preferably higher than about 20 torr, and most preferably about 10 torr. The higher vacuum increases production efficiency, however in the conventional casting method the vacuum was limited due to casting defects caused by the very high speed with which the molten metal was charged into the molding cavity. Because a vacuum of 50–100 torr is used in the conventional vacuum die casting method, the vacuum casting method of the present invention is distinguishable over the conventional vacuum die casting method. The vacuum must be higher than that of conventional methods to work properly. Casting products having a quality as high as that of the conventional vacuum die casting method can be obtained at a higher vacuum than 20 torr in the method of the present invention.

Substantially simultaneously with the reduction of pressure in the molding cavity 6, the pressure acting on the free surface of the molten metal held in the molten metal holding furnace 22 is increased so that a portion of the molten metal 24 held in the furnace 22 is raised into the molten metal retaining dome 8. The rising speed of a surface of the molten metal in the stalk 20 and in the molten metal retaining dome 8 at a later stage of the rising motion of the molten metal is controlled to be about 5–10 cm/sec. When the increase in the gas pressure acting on the molten metal held in the furnace 22 is stopped, the surface of the molten metal in the molten metal retaining dome 8 may oscillate for a few seconds due to a cushion effect of the gas inside the closed chamber in which the furnace 22 is housed.

Figure 3:
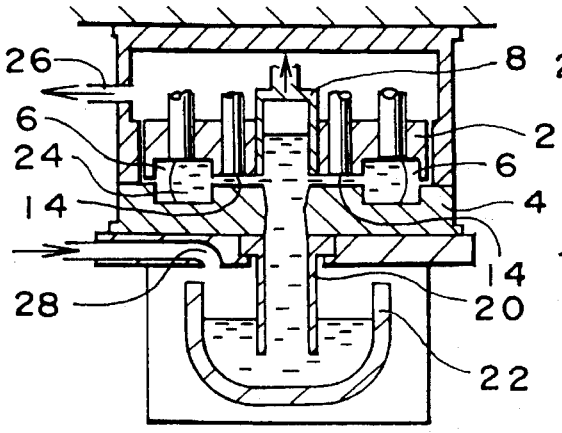
FIG. 3 is a cross-sectional view of the apparatus of FIG, 1 in a state where a molten metal is charged into the molding cavity.

Then, as illustrated in FIG. 3, the gate 10 is opened so that the molten metal 24 in the molten metal retaining dome 8 is charged into the molding cavity 6 at a high speed due to a pressure difference between the vacuum in the molding cavity 6 and the atmospheric pressure retained inside the molten metal retaining dome 8. The charging speed of the molten metal running in the molding cavity 6 is controlled to be about 7 m/sec. This speed is much higher than the charging speed of molten metal in the conventional casting method, which is typically about 0.5 m/sec. This high charging speed improves the running characteristic of molten metal in the molding cavity and allows thinner cast products to be formed. In conventional die casting methods, the molten metal tends to have bubbles, and also, a hydraulic cylinder needs to be provided to push the molten metal into the molding cavity at a high speed. In the vacuum casting method of the present invention, no bubbles are mixed in the molten metal when charged into the molding cavity due to the vacuum generated in the molding cavity 6, and this, together with the method which avoids air involvement in the stalk and retaining dome, provides a method wherein no casting defects due to air involvement are generated. Further, since the molten metal can flow at a high speed due to the vacuum generated in the molding cavity, no hydraulic cylinder needs to be provided.

Figure 4:
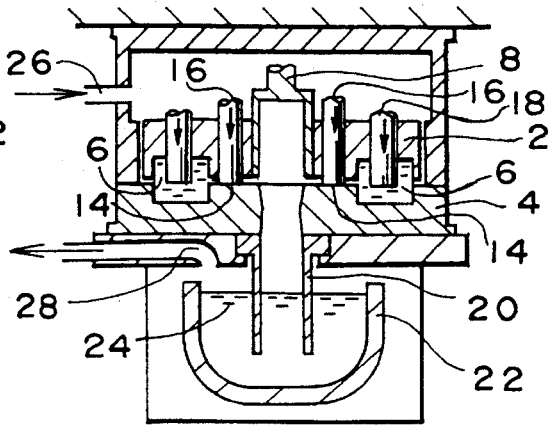
FIG. 4 is a cross-sectional view of the apparatus of FIG. 1 in a state where the molding cavity has been closed and a pressure pin is operated.
Figure 5:
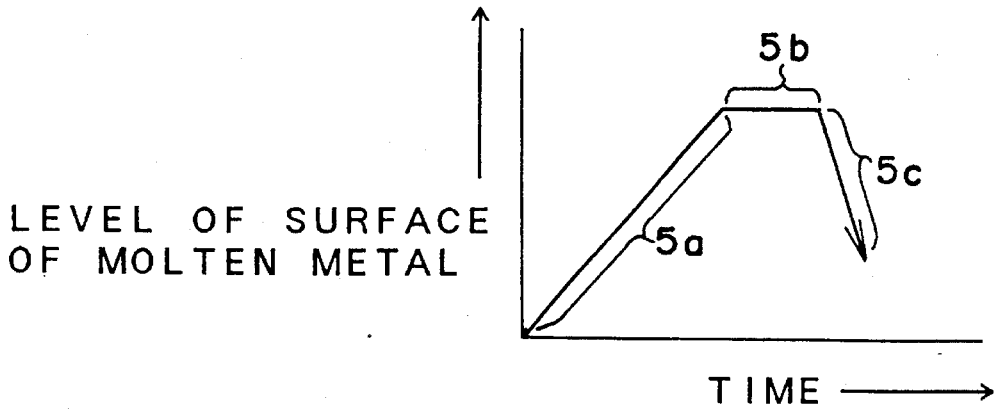

Then, as illustrated in FIG. 4, the shut pin 16 is lowered relative to the upper die 2 to shut the runner 14 and to therefore close the molding cavity 6 filled with molten metal. Then, the pressure pin 18 is inserted into the molding cavity 6 filled with the molten metal to pressurize the molten metal. Thereafter, the molten metal in the molding cavity 6 is cooled naturally or forcibly. While the molten metal is cooled, the gas pressure acting on the molten metal held in the the molten metal holding furnace 22 and the vacuum pressure generated in the molding cavity are both in a released condition. After the molten metal is solidified, the molding die is opened, and the cast product is taken out from the molding die. The inside surface of the molding die defining the molding cavity is then coated with a mold release agent and is prepared for the next molding cycle.

Next, structures and operation specific to a vacuum casting method in accordance with each embodiment of the present invention will be explained.

With the first embodiment of the present invention, as illustrated in FIG. 5, during the step of raising a portion of the molten metal 24 held in the molten metal holding furnace 22 in the molten metal retaining dome 8 shown as portion 5*a* of the curve, the rising speed of the molten metal is controlled to be about 5–10 cm/sec at all stages of the rising motion of the molten metal. When the surface of the molten metal rises to a level higher than the runner 14, the motion is stopped rising, as shown by portion 5*b* of the curve, and maintained for about 2–10 seconds to allow for stabilization of any movement or oscillation of the upper surface of the molten metal. Then, at the intersection of portions 5*b* and 5*c* of the curve, the gate 10 is opened and by raising the molten metal retaining dome 8 the molten metal 24 is charged from the molten metal retaining dome 8 into the molding cavity 6 as shown by portion 5*c* of the curve in FIG. 5.

The reason for controlling the rising speed of the molten metal to be about 5–10 cm/sec is as follows:

It was found in tests that when the molten metal was raised at a speed higher than about 10 cm/sec in the stalk 20 having an inside surface of ceramics, a non-negligible air involvement occurred. FIG. 7A illustrates molten metal rising in a stalk 20 at a speed lower than about 10 cm/sec. FIG. 7B illustrates that when the rising speed is higher than 10 cm/sec, larger ripples 25 are caused at the surface of the molten metal and bubbles 102 become involved in a portion of the molten metal adjacent to the surface and which contact the inside surface of the stalk 20. If the rising speed of the molten metal were lower than 5 cm/sec, the production efficiency would be seriously lowered.

The rising speed of the molten metal is controlled by controlling the pressure imposed on the surface of the molten metal 24 held in the molten metal holding furnace 22, via the pressure port 28.

In accordance with the first embodiment of the present invention, since the molten metal is raised via the stalk 20 into the molten metal retaining dome 8 at the speed of about 5–10 cm/sec, air involvement by the molten metal as shown in FIG. 7B does not occur.

Furthermore, when the molten metal rising is stopped, the stopped state is maintained for about 2–10 seconds during which time oscillation of the surface of the molten metal stabilizes. More particularly, when the molten metal stops rising relatively suddenly, the surface of the molten metal will oscillate in the molten metal retaining dome 8 due to a cushion effect of the air existing inside the molten metal holding furnace 22. However, the oscillation will stop in about 2–10 seconds. The gate 10 is opened after the oscillation has stopped so that bubbles and oxidized metal pieces floating at a surface portion of the molten metal do not flow into the molding cavity to cause casting defects.

In the second embodiment of the present invention, as illustrated in FIG. 6, the rising speed of a portion of the molten metal 24 in the molten metal retaining dome 8 via the stalk 20 is changed between an early stage 6*a* of the rising motion of the molten metal and a later stage 6*b* of the rising motion of the molten metal. The rising speed at the later stage of the rising motion of the molten metal is controlled to be lower than the rising speed at the early stage of the rising motion of the molten metal. More particularly, the rising speed at the later stage 6*b* of the rising motion of the molten metal is controlled to be about 5–10 cm/sec, while the rising speed at the early stage 6*a* of the rising motion of the molten metal is controlled to be a speed higher than about 10 cm/sec. The rising speed at the early stage 6*a* of the rising motion of the molten metal may be changed to various speeds and the speeds may be greater than 10 cm/sec.

When the surface of the molten metal has reached a level higher than the runner 14, the rising motion of the molten metal is stopped as shown by 6*c*. After an interval of about 2–10 seconds, the gate 10 is opened and the molten metal in the molten metal retaining dome 8 is charged into the molding cavity 6. The reason for providing the interval of about 2–10 seconds is to allow stabilization of the oscillation of the surface of the molten metal in that interval.

The reason for setting the rising speed of the molten metal at the later stage 6*b* of the rising motion at about 5–10 cm/sec is the same as that discussed in the first embodiment of the invention; that is, to prevent the rising molten metal from involving air.

The reason for setting the rising speed of the molten metal at the early stage 6*a* of the rising motion of the molten metal at a speed higher than about 10 cm/sec is that even if the molten metal involves air at the early stage 6*a* of the rising motion, a sufficient time period remains before the gate 10 is opened, and thus the bubbles 102 can move and reach the surface of the molten metal before the molten metal is charged into the molding cavity 6. Therefore, the rising speed of the molten metal is allowed to be increased to shorten the casting cycle time.

According to the present invention, the following advantages are obtained:

With the first embodiment of the present invention, since the rising speed of the molten metal in the stalk and the molten metal retaining dome is controlled to be about 5–10 cm/sec, air involvement by the molten metal is effectively prevented, so that a high quality of casting products is maintained.

With the second embodiment of the present invention, since the rising speed of the molten metal in the stalk and in the molten metal retaining dome at an early stage of the rising motion is controlled to be a speed higher than about 10 cm/sec while the rising speed of the molten metal at a later stage of the rising motion is controlled to be about 5–10 cm/sec, the casting cycle time can be shortened while at the same time preventing air involvement by the molten metal.

Although only a few embodiments of the invention have been described in detail above, it will be appreciated by those skilled in the art that various modifications and alterations can be made to the particular embodiments shown without materially departing from the novel teachings and advantages of the present invention. Accordingly, it is to be understood that all such modifications and alterations are included within the spirit and scope of the present invention as defined by the following claims.

What is claimed is:

1. A vacuum casting method comprising the steps of:

isolating a molding cavity defined by a die from a molten metal retaining dome;

reducing pressure in said molding cavity defined by said die;

moving molten metal through said molten metal retaining dome at a final rising speed of between about 5 and 10 cm/sec;

opening a passage between said molding cavity defined by said die and said molten metal retaining dome to charge said molten metal moved through said molten metal retaining dome into said molding cavity defined by said die;

pressurizing said molten metal in said molding cavity defined by said die; and allowing said molten metal in said molding cavity defined by said die to solidify.

2. A vacuum casting method according to claim 1, wherein said moving step includes a step of moving said molten metal through said molten metal retaining dome at a rising speed of about 5–10 cm/sec at all times during said moving step.

3. A vacuum casting method according to claim 1, wherein said moving step includes the steps of moving molten metal through said molten metal retaining dome at an early stage rising speed greater than about 10 cm/sec and then moving molten metal through said molten metal retaining dome at a final rising speed of between about 5 and 10 cm/sec.

4. A vacuum casting method according to claim 1, further comprising the step of stopping said movement of molten metal through said molten metal retaining dome for between about 2 to 10 seconds when said molten metal moving in said molten metal retaining dome reaches a level higher than said passage before opening said passage.

5. A vacuum casting method according to claim 1, further comprising the step of moving molten metal through a stalk which has an inside surface constructed of ceramics, said stalk connecting said molten metal retaining dome with a molten metal source.

6. A vacuum casting method according to claim 1, wherein said speed of said molten metal movement is controlled by controlling pressure acting on molten metal held in a molten metal source supplying molten metal to said molten metal retaining dome.

7. A vacuum casting method according to claim 3, wherein said molten metal is moved at a plurality of early stage speeds including a speed greater than about 10 cm/sec.

* * * * *

UNITED STATES PATENT AND TRADEMARK OFFICE

CERTIFICATE OF CORRECTION

PATENT NO. : 5,462,107

DATED : November 21, 1995

INVENTOR(S) : Kohno

It is certified that error appears in the above-indentified patent and that said Letters Patent is hereby corrected as shown below:

Column 4, Line 61, after "transistor" insert --,--;

delete "the" (second occurrence);

Line 67, after "having" insert --an--;

Column 5, Line 11, change ";" to --,thereby--;

Column 6, Line 3, delete "is";

Line 5, change "hold" to --hole--.

Signed and Sealed this

Eleventh Day of June, 1996

Bruce Lehman

*Attest:*

BRUCE LEHMAN

*Attesting Officer*

*Commissioner of Patents and Trademarks*